US010130841B2

(12) United States Patent
Helanto

(10) Patent No.: US 10,130,841 B2
(45) Date of Patent: Nov. 20, 2018

(54) BOXING TRAINING DEVICE

(71) Applicant: Nolit, Kirkkonummi (FI)

(72) Inventor: Olli Helanto, Kirkkonummi (FI)

(73) Assignee: NOLIT, Kirkkonummi (FI)

( * ) Notice: Subject to any disclaimer, the term of this patent is extended or adjusted under 35 U.S.C. 154(b) by 0 days.

(21) Appl. No.: 14/641,724

(22) Filed: Mar. 9, 2015

(65) Prior Publication Data

US 2015/0258374 A1 Sep. 17, 2015

(30) Foreign Application Priority Data

Mar. 11, 2014 (FI) ..... 20145222

(51) Int. Cl.

| | |
|---|---|
| ***A63B 24/00*** | (2006.01) |
| ***A63B 69/00*** | (2006.01) |
| ***A63B 69/32*** | (2006.01) |
| ***A63B 71/06*** | (2006.01) |
| ***A63B 69/20*** | (2006.01) |

(52) U.S. Cl.

CPC ..... *A63B 24/0062* (2013.01); *A63B 69/0053* (2013.01); *A63B 69/20* (2013.01); *A63B 69/32* (2013.01); *A63B 71/0622* (2013.01); *A63B 2071/0683* (2013.01); *A63B 2207/02* (2013.01); *A63B 2210/50* (2013.01); *A63B 2220/17* (2013.01); *A63B 2220/30* (2013.01); *A63B 2220/53* (2013.01); *A63B 2220/62* (2013.01); *A63B 2225/50* (2013.01); *A63B 2244/102* (2013.01)

(58) Field of Classification Search

CPC ..... A63B 69/004

See application file for complete search history.

(56) References Cited

U.S. PATENT DOCUMENTS

| | | | | |
|---|---|---|---|---|
| 4,883,271 | A * | 11/1989 | French | A63B 24/0021 273/454 |
| 5,605,336 | A | 2/1997 | Gaoiran et al. | |
| 9,011,292 | B2 * | 4/2015 | Weast | G06F 19/3481 482/1 |
| 2003/0216228 | A1 | 11/2003 | Rast | |
| 2004/0097347 | A1 | 5/2004 | Ghim | |
| 2004/0132559 | A1 | 7/2004 | Bellows et al. | |

(Continued)

FOREIGN PATENT DOCUMENTS

| | | |
|---|---|---|
| DE | 202007002216 | 4/2007 |
| FR | 2875417 | 3/2006 |

(Continued)

OTHER PUBLICATIONS

Extended Search Report, dated Jul. 21, 2015; Application No. 15 15 7072.

(Continued)

*Primary Examiner* — Loan H Thanh
*Assistant Examiner* — Rae Fischer
(74) *Attorney, Agent, or Firm* — Berggren LLP

(57) ABSTRACT

A boxing training device (1) for using with a punching bag (31) includes at least one sensor (61) to measure punches, feedback equipment (5) for giving feedback to a user, and control equipment (6) for controlling the device. The device further includes signalling equipment (4) in order to give signals to the user, a central processing unit (3), a power source (66) and a belt (2) including pockets (9, 10).

13 Claims, 2 Drawing Sheets

(56) References Cited

U.S. PATENT DOCUMENTS

Figure 1:
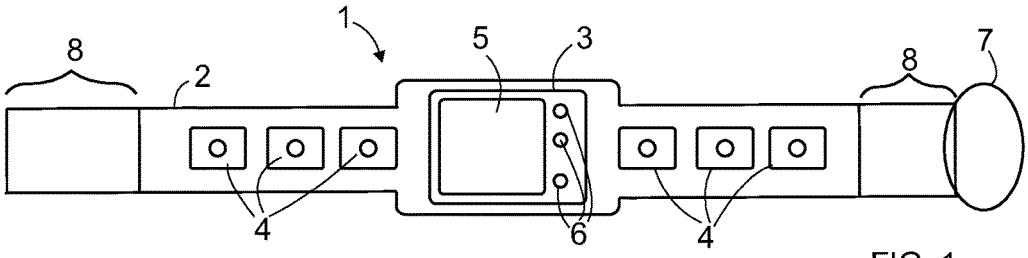

| | | | |
|---|---|---|---|
| 2005/0266967 | A1 | 12/2005 | Considine et al. |
| 2008/0174548 | A1 | 7/2008 | Jones |
| 2012/0053016 | A1 | 3/2012 | Williamson |
| 2012/0108394 | A1 | 5/2012 | Jones et al. |
| 2012/0220430 | A1 | 8/2012 | Bucar et al. |

FOREIGN PATENT DOCUMENTS

| | | |
|---|---|---|
| GB | 2355803 | 5/2001 |
| JP | 08-112390 | 5/1996 |
| WO | 2004/070336 A1 | 8/2004 |
| WO | 2010-065171 | 6/2010 |

OTHER PUBLICATIONS

FI Search Report, dated Oct. 29, 2014, from corresponding FI application.

* cited by examiner

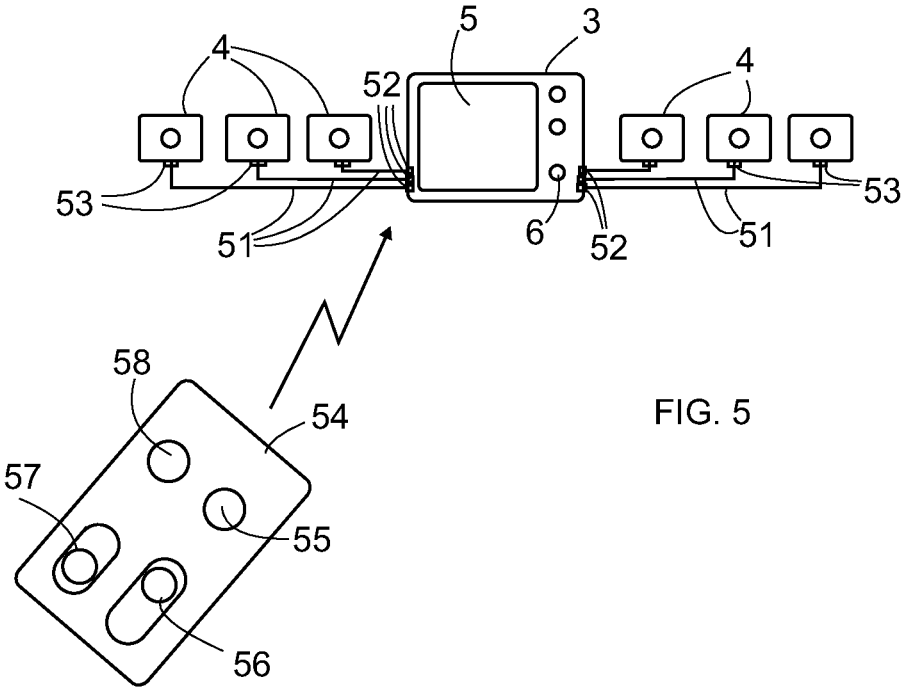
FIG. 5
FIG. 6
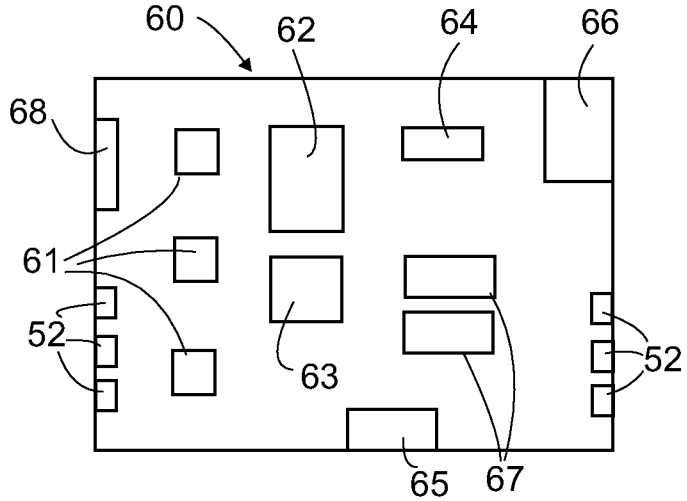

BOXING TRAINING DEVICE

FIELD OF TECHNOLOGY

The present invention relates to a boxing training device. Especially the invention relates to a boxing training device that can be used with a punching bag.

PRIOR ART

When training boxing it is known that a coach gives an athlete instruction to hit a certain series of punches. It is also known to use specific training devices for improving the training. US20030216228 discloses known training devices that are fixed into a punching bag. One device is a module that is fixed on the top of the punching bag. The module comprises a printed circuit board having acceleration sensors for detecting punches received by the punching bag. The module gives audio feedback to the athlete. The audio feedback is, for example, a short low groan or a groan with higher intensity. The feedback depends on how hard the punch is. The problem of the module is that it is fixed to the top of the punching bag, which is soft. The softness of the top part hinders the detections of the punches, so the punching bag requires modification in order that the module would work properly.

Another embodiment of US20030216228 discloses a tube inside the punching bag. The tube comprises a lower sensor and an upper sensor for detecting punches. The top of the tube has a transmitter for transmitting detected puncher to a separate control and audio generating unit. The embodiment requires also modifications to the punching bag, because the tube with the sensor must be installed properly into the bag. US20120220430 discloses also a tube with sensors to be installed into the punching bag.

US20050266967 discloses yet another device that can be fixed to the punching bag. In this embodiment the sensors are situated vertically on the bag. The control unit of the system can also be attached on the bag. A separate led device is connected to the control unit. The installation on to the punching bag is tedious. US20120108394 discloses a more sophisticated training device having punching pad onto which an athlete hits.

The known devices are oriented to competitors and professional boxers more than athletes who fitness train. The devices are rather complex and uneasy to install and use in a normal fitness hall. Therefore they are not very popular.

Short Description of Invention

The aim of the invention is eliminate problems of the known solutions. The aim is achieved by a way described in an independent claim. Dependent claims disclose different embodiments of the invention.

According to an embodiment of the invention a boxing training device for using with a punching bag comprises at least one sensor to measure punches, feedback equipment for giving feedback to a user, and control equipment for controlling the device. The device further comprises signalling equipment in order to give signals to the user, a central processing unit, a power source and a belt comprising pockets, the feedback equipment comprising a display unit, The sensor/s, the display unit, the control equipment, the power course, and the signalling equipment are connected to the central processing unit, all of them being in the pockets of the belt. The belt has a buckle and length in order to be tighten around the punching bag. The signalling equipment covers a sector being at least 160 degrees when the belt is around the punching bag.

LIST OF FIGURES

Figure 2:
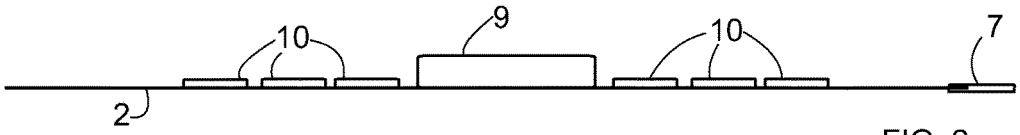
Figure 3:
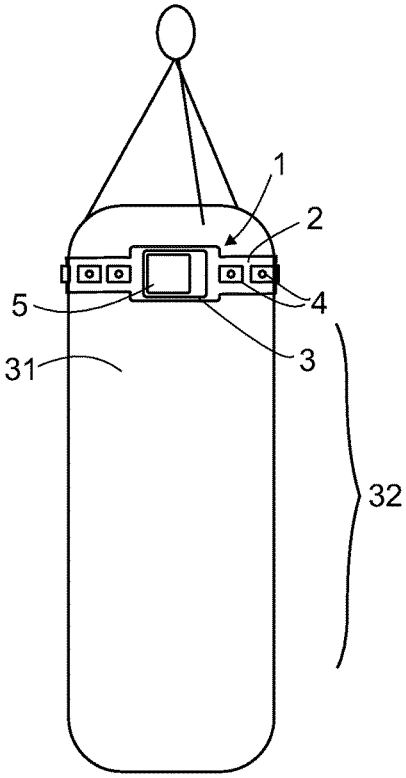
Figure 4:
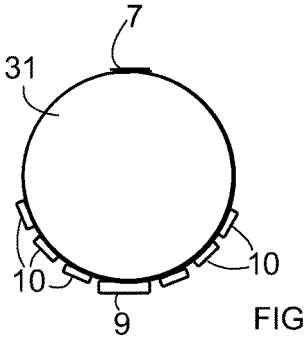

In the following, the invention is described in more detail by reference to the enclosed drawings, where FIG. 1 illustrates a schematic example of the training device according to the invention, FIG. 2 illustrates the training device of FIG. 1 from another view, FIG. 3 illustrates an installation example, wherein the inventive training device has been installed around a punching bag, FIG. 4 illustrates the example of FIG. 3 from the top view, FIG. 5 illustrates a schematic example of the training device without a belt, and with a remote control, and FIG. 6 illustrates a schematic example of a circuit board of a central processing unit.

DESCRIPTION OF THE INVENTION

FIG. 1 illustrates an example of a boxing training device 1 for using with a punching bag. The device comprises a belt 2 having pockets 9, 10 as showed in FIG. 2. A central processing unit 3, and signalling equipment 4 are situated into the pockets. The signalling equipment gives signals to the user.

The device further comprises feedback equipment 5 for giving feedback to a user, which equipment has a display unit in this example. The display unit can be a LED display, for example. The belt has a buckle 7, and the length of the belt is enough in order that the belt can be tighten around the punching bag. In order to secure a tight fastening of the belt may comprise a Velcro surface 8, or surfaces as in the example of FIG. 1 at the both ends of the belt. The device comprises also control equipment 6 for controlling the device. The control equipment can be a button or buttons on the central processing unit 3.

The device further comprises at least one sensor 61 to measure punches, and a power source 66. See FIG. 6. The power course can comprise a battery. These elements can be situated in the central processing unit 3. They can also be situated into the pockets of the belt in which case they are connected to the central processing unit. The sensor/s can be acceleration or gyro sensors or declinators or a mix of the different types.

The sensor/s 61, the display unit 5, the control equipment 6, the power course 66, and the signalling equipment 4 are in connection with the central processing unit, all of them being in the pockets of the belt. The signalling equipment covers a sector being at least about 90 degrees when the device 1 (the belt 2) is around the punching bag.

FIG. 3 shows how the inventive training device 1 can be attached on a punching bag 31. The punching bag has a cylindrical shape which contains a material, such as sawdust, sand, or other impact absorbing material. The cylindrical shape allows the bag to be struck from any side and these striking bags are generally supported vertically from a ceiling. The punching area 32 is in the middle of the bag. The training device is not desired to be attached in this area, because it may get broken by the hits of the user, or it may hurt the hands of the user. A convenient place is above the middle part, horizontally around the punching bag as showed in FIG. 3. This area is soft, so belt of the device should be fasten tightly around the bag. Otherwise the sensors 61 may not measure/detect the punching. The side of the bag above the punching area is also a good position in order to deliver signals by the signalling equipment to the user. In this way the head of the user is relatively in good level when compared to the training device.

FIG. 4 shows the punching bag from the top view. The signalling equipment is used to give signals to the user. The signals indicate instructions how many times the user (boxer) should hit. Because the punching bag moves due to the punches, and the user moves also, the signalling equipment 4 should cover a large enough sector. Otherwise the user may not notice the signal or he/she has difficulties in noticing the signal. It has been noted that good training condition with good noticing of the signals can be obtained when the signalling equipment is in the sector between about 90-180 degrees like in the example of FIG. 4. About 90 degrees or about 180 degrees means in this context +−5 degrees. It has also been noticed in practice that the sector with the signalling equipment does not need to be larger than about 180 degrees.

The signalling equipment 4 has several light units covering the sector. The lights of the units can, for example, be LED lights. When the lights are switched on, it is time to hit. The central processing unit controls the light units to be on or off. The lights create a number of different colours. A certain colour indicates to the user to hit a certain number of punches. For example, red (the first colour) can indicate that the user is expected to hit one hit; green (second colour) indicates two hits; and blue (the third colour) 3 hits or so on. The greater the order number of the colour is, the greater the number of the expected hits is. It is a matter of programming/configuring the central processing unit what is the first colour, second colour and so on. It is convenient to have at least three colours, because the series of one, two and three hits are most common in practice. It can be noted that the boxer and a trainer have freedom to decide whether the hit or hits are straight, hooks, left-hand hit, right-hand hit and so on.

It is also possible that the signalling equipment has loudspeakers covering the said sector. It may also be possible that only the central processing unit comprises a loudspeaker. The voice of the loudspeaker/s can be used with the above said lights for giving an extra signal for the user. The voice can be a simple tone. A convenient number of the lights or the loudspeakers is between 6-10. However any suitable number of the lights/loudspeakers can be used.

FIG. 5 shows connections between different parts of the training device. The signalling equipment 4, i.e. the lights units (and additionally the loudspeakers) are provided with an input connections 53. The central processing unit 3 is provided with output connections 52 for sending instructions to switch on and off the lights (the loudspeakers. Cables 51 are between the output 52 and input 53 connections. This kind of structure makes it possible to replace a broken part easily. For example if the light unit or the cable is broken, the connection/s of the broken part can be open and a new unbroken part can be replaced.

FIG. 5 also shows a remote control 54 that can control the training device 1. The remote control controls the device wirelessly, for example using a suitable radiofrequency, Bluetooth or other suitable technique. The remote control is especially handy for a trainer who guides the boxer. So, the control equipment can comprise the remote control unit. The remote control can control the actions of the central processing unit 3. It is possible that the remote control unit is arranged to control more than one central processing unit and said devices. This is handy for a trainer guiding, for example, several users who train.

The remote control comprises at least some control switches like buttons and/or sliding switches. A simple embodiment of the remote control can have a button 55 for switching on/off, and a sliding switch 56 for selecting a number of hits, for example. A more sophisticated embodiment may in addition comprise another button 58 to select a mode to control one training device or another mode to control several training devices. Further additional switches can, for example, be switch/switches to drive lights units via the central processing unit, switch/switches to drive loudspeaker/s, and a switch to show results of the training session on the display 5. The embodiment of the remote control relates to the programming of the training device.

As already said above, the control equipment can comprise control buttons 6 that are integrated to the central processing unit 6. The number of these buttons relates also how the training device is programmed and constructed. If the display is a touch screen, not so many physical buttons are needed. However, it is convenient to have a physical button for switching on and off. Other buttons can, for example, be a button for showing results of a training session, and a button for testing the device.

As already illustrated above, the display unit, and the power course can be integrated with the central processing unit providing one unit. The central processing unit comprises other parts as well. FIG. 6 show an example of the parts of the central processing unit 3. The unit comprises a circuit board 60 that is provided with a memory 62, a processor 63, a display driver 64, the above said output connections 52, a receiver unit 65 for receiving transmission from the remoter control, driver unit/s 67 for the light units (and possibly for the loudspeakers), and a possible interface 68, like a USB port, Bluetooth interface or another suitable interface for transmitting information (training results or reprogramming data) between a computer, smart phone or another suitable device.

FIG. 6 shows only one possible solution to construct the circuit board of the central processing unit 3. For example, the interface 68 may not be required. It is clear the training device 1 according to the invention can be obtained in many several ways. The functionality of the training device and the complexity of the physical parts can be chosen in order to manufacture a desired product version. So several product versions can be made.

The inventive training device is easy to switch on by the switching button or the like. The different colours indicate clearly to the user how many hits should be stricken, so the central processing unit is arranged to detect as may hits as the lights indicate. The central processing unit measures speed and timing of the detected hits starting from the moments when the specific colours are switched on. The central processing unit may also measure strength of the detected hits. After the training session the boxer can see the results from the display as feedback. The results can be kept in the memory as long as needed in order to follow improvement of the boxer. If the central processes unit is equipped with the interface 68, it is also possible to transmit the results to a computer or the like. The remote control is also very handy to a trainer to control the training session. Therefore the invention makes it possible to train alone or with the trainer. Although boxers are mentioned above as being users of the invention, it is suitable for athletes practicing other strike related martial arts like karate, taekwondo or kickboxing. The invention is especially suitable for the users who fitness train. The height of the user can also be taken into account. The training device can be fasten onto the bag at the height of the user's head or a little over the head, for example 10 centimetres over the head.

The invention is easy to install onto the punching bag in such a way that the hits can be detected in a reliable way. The most part of the belt 2 of the inventive device can be narrower than the part having the central processing unit 3. This helps to fasten the belt tightly around the punching bag. When the signalling equipment is situated vertically, the user can easily notice the signals from the equipment despite of the movement of the punching bag or the user. The pockets can, for example, be designed to open towards the punching bag. In this embodiment the belt must be unfasten before a broken part can be changed to an unbroken piece.

It is evident from the above that the invention is not limited to the embodiments described in this text but can be implemented in many other different embodiments within the scope of the claims.

The invention claimed is:

1. A boxing training device for a punching bag, the device comprising:

an adjustable belt capable of being tightened around the punching bag and having a multitude of pockets housing a central processing unit, at least one sensor, a feedback equipment having a display unit, a control equipment for operating the central processing unit, a power source, and a signaling equipment, wherein the at least one sensor, the feedback equipment, the control equipment, the signaling equipment, and the power source are connected to the central processing unit, and the signaling equipment covers a sector of at least 90 degrees when the belt is tightened around the punching bag and the signaling equipment comprises signaling lights of several colors arrayed across the sector and being operated by the central processing unit during a boxing training session to switch on signaling lights in a predetermined order, wherein each color of the signaling lights indicates to a user a predetermined number of hits the user is expected to punch at the time of the light turns on, and the at least one sensor is capable of measuring at least a number and timing of hits punched, and the feedback equipment is capable of providing feedback of the measured number of the hits punched in relation to the color of the signaling lights turned on before the hits, and feedback of the timing of the hits punched in relation to time when the signaling lights were switched on, and wherein the control equipment comprises control buttons that are integrated to the central processing unit and a remote-control unit to control the central processing unit for a trainer to control the signaling lights during a training practice.

2. The boxing training device according to claim 1, wherein the signaling equipment covers a sector of 90 and 180 degrees when the belt is tightened around the punching bag.

3. The boxing training device according to claim 1, wherein the signaling equipment comprises signaling lights of at least three different colors, and the central processing unit is arranged to control the lights of the signaling equipment by using a first of said colors to indicate to the user to hit once, a second of said colors to hit twice, and a third of said colors to hit three times.

4. The boxing training device according to claim 3, wherein a number of lights is between 6-10.

5. The boxing training device according to claim 1, wherein the belt comprises a hoop-and-loop fastener surface.

6. The boxing training device according claim 1, wherein the at least one sensor is situated on the central processing unit.

7. The boxing training device according to claim 6, wherein the at least one sensor is an acceleration or gyro sensor or a declinator or a mix thereof.

8. The boxing training device according to claim 1, wherein the central processing unit comprises a circuit board.

9. The boxing training device according to claim 8, wherein the display unit and the power source are integrated with the central processing unit providing one unit.

10. The boxing training device according to claim 2, wherein the signaling equipment comprises signaling lights of at least three different colors, and the central processing unit is arranged to control the lights of the signaling equipment by using a first of said colors to indicate to the user to hit once, a second of said colors to hit twice, and a third of said colors to hit three times.

11. The boxing training device according to claim 10, wherein a number of the lights is between 6-10.

12. A boxing training device for a punching bag, the device comprising:

a belt configured to be tightened around the punching bag and having a plurality of pockets housing:

a central processing unit (CPU) with a control that operates the CPU;

a signal equipment comprising a plurality of signaling lights of different colors and being operated by the CPU during a boxing training, the signal equipment giving visual instruction signals to a user before the user punches the punching bag in a form of different light colors during the boxing training indicating how many punches the user is to throw next during the boxing training;

a sensor connected to the CPU and configured to measure a number, an impact and timing of the thrown punches on the punching bag;

a display separate from the signal equipment and connected to the CPU, the display being adapted to indicate accuracy of the measured number, impact and timing of the punches thrown on the punching bag in relation to the visual instruction signals given by the signal equipment before the punches; wherein the control comprises control buttons that are integrated to the CPU and a remote-control unit to control the CPU for a trainer to control the signaling lights during a training practice.

13. An arrangement comprising a plurality of boxing training devices according to claim 1 and a remote control capable of controlling the central processing units of the plurality of boxing training devices for a trainer to control the signaling lights of the plurality of devices during a training practice.

* * * * *